US005675878A

United States Patent [19]

Brown et al.

[11] Patent Number: 5,675,878

[45] Date of Patent: Oct. 14, 1997

[54] APPARATUS TO MERGE AND TEXTURIZE MULITPLE FILAMENT YARNS

[75] Inventors: Robert Saul Brown, Spartanburg; Ralph Allen Cantrell, Chesnee, both of S.C.

[73] Assignee: Milliken Research Corporation, Spartanburg, S.C.

[21] Appl. No.: 771,350

[22] Filed: Dec. 16, 1996

[51] Int. Cl.[6] ..... D02G 1/16; D02J 1/08

[52] U.S. Cl. ..... 28/271; 28/172.2; 28/178

[58] Field of Search ..... 28/172.1, 172.2, 28/178, 220, 254, 256, 271, 278

[56] References Cited

U.S. PATENT DOCUMENTS

| | | | |
|---|---|---|---|
| 4,259,768 | 4/1981 | Clendening, Jr. et al. | 28/272 |
| 4,290,177 | 9/1981 | Price et al. | 28/272 |
| 4,547,938 | 10/1985 | Cullen et al. | 28/272 |
| 4,644,622 | 2/1987 | Bauer et al. | 28/272 |
| 4,715,097 | 12/1987 | Bogucki-Land | 28/272 |
| 5,590,447 | 1/1997 | Goineau | 28/172.1 |

*Primary Examiner*—C. D. Crowder
*Assistant Examiner*—Larry D. Worrell, Jr.
*Attorney, Agent, or Firm*—Terry T. Moyer; Earle R. Marden

[57] ABSTRACT

Apparatus to continuously draw, texture and warp polyester yarn in which the texturing apparatus includes texturing balls mounted on a common mount for a plurality of texturing positions which individually can be rotated into and out of position without individual adjustment of each ball after rotation back into operative position.

7 Claims, 4 Drawing Sheets

APPARATUS TO MERGE AND TEXTURIZE MULITPLE FILAMENT YARNS

This invention relates to the continuous production of drawn and texturized POY yarn supplied from individual bobbins and wound on a single warp beam.

It is known to draw and texturize POY yarns and take them up on individual bobbins, then creel the individual bobbins and take them up on a single warp beam. This is a discontinuous operation since the bobbins of drawn and textured yarn have to be creeled prior to warping.

Therefore it is an object of this invention to describe an apparatus and process in which POY yarns are continuously drawn, textured and warped without creeling between texturing and warping.

Other objects and advantages of the invention will become clearly apparent as the specification proceeds to describe the invention with reference to the accompanying drawings, in which.

Figure 1:
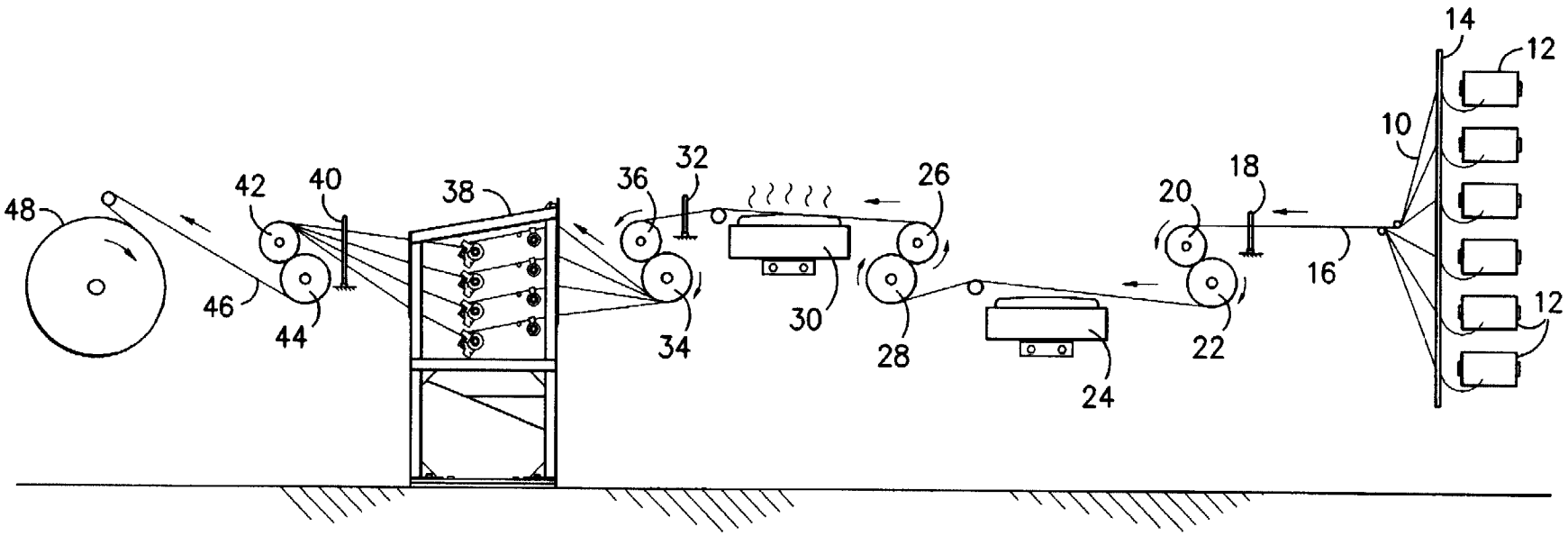
FIG. 1 is a side schematic view of the new and improved process.

Looking now to the drawings, the reference number 10 represents a single ply, 255 denier, filament polyester yarn supplied from bobbins 12 mounted on a creel 14 supplied in sheet form through a comb 18 to maintain the yarns 10 separate from one another. In the preferred form of the invention, the apparatus sequentially includes a set of feed rolls 20 and 22, a contact heater 24, a second set of feed rolls 26 and 28, a second contact heater 30, a comb 32, a third set of feed rolls 34 and 36, a texturing apparatus 38, a comb 40, and another set of feed rolls 42 and 44 supplying the textured yarn 46 to the warp beam 48.

The above system can be operated in several different manners by the use of the heaters 24 and 30 and the feed rolls. For example, heater 24 can be used as a pre-heater prior to drawing of the yarn in contact with the heater 30 or drawing the yarn in contact with the heater and using the heater 30 to relax the drawn yarn or use the system as in the preferred form of the invention wherein the heater 24 is deactivated.

In the preferred form of the invention, the yarn 10 as mentioned before is a single ply 255 denier, 68 filament polyester yarn supplied at a rate of 265 yards per minute by the feed rolls 20, 22. The yarn 10 can be other synthetic yarns such as nylon, polypropylene, etc. but polyester is preferred. From the rolls 20, 22, the yarn sheet 16 passes over the heater 24, which is deactivated, to the feed rolls 26, 28 which delivers the yarn at a rate of 268 yards per minute. Since the rolls 34, 36 are taking yarn at a rate of 450 yards per minute, the yarn 10 as it passes over the heater 30, operating at a temperature of 210° C. is drawn to a 150 denier by a draw ratio of 1.68. From the feed rolls 34, 36, the yarns 10 are supplied to the texturing apparatus at an overfeed rate in the range of 4–15%, preferably 11%, to texture, entangle and bulk the individual filaments of each yarn with the amount of overfeed being selected to enhance the bulking of the yarn. From the texturing apparatus 38, the yarns 10 pass through the comb 40 to maintain the spacing of the yarns from one another prior to supplying same to the warp beam 48 by the feed rolls 42, 44 supplying yarn at a rate of 410 yards per minute. The feed rate between the rolls 42, 44 and 34, 36 controls the amount of overfeed to the texturing apparatus.

The texturing and bulking apparatus 38 consists of a water application section 52 and a texturing section 54 mounted in a suitable frame 56. Located in the bottom of the frame 56 is a drain pan 58 connected to a disposal area by a hose 60.

Figure 2:
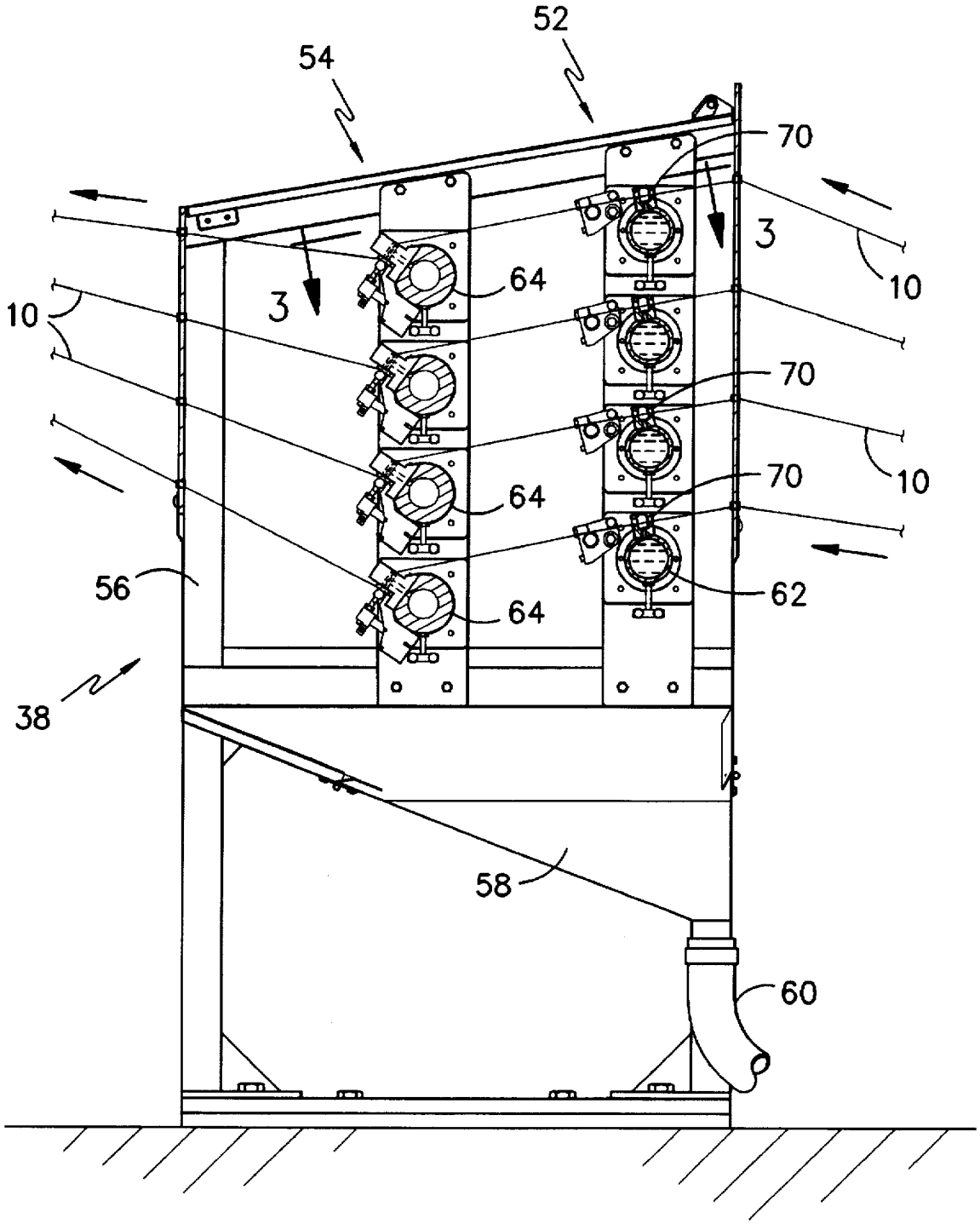
FIG. 2 is a blown-up side view of the yarn texturing apparatus of FIG. 1.
Figure 3:
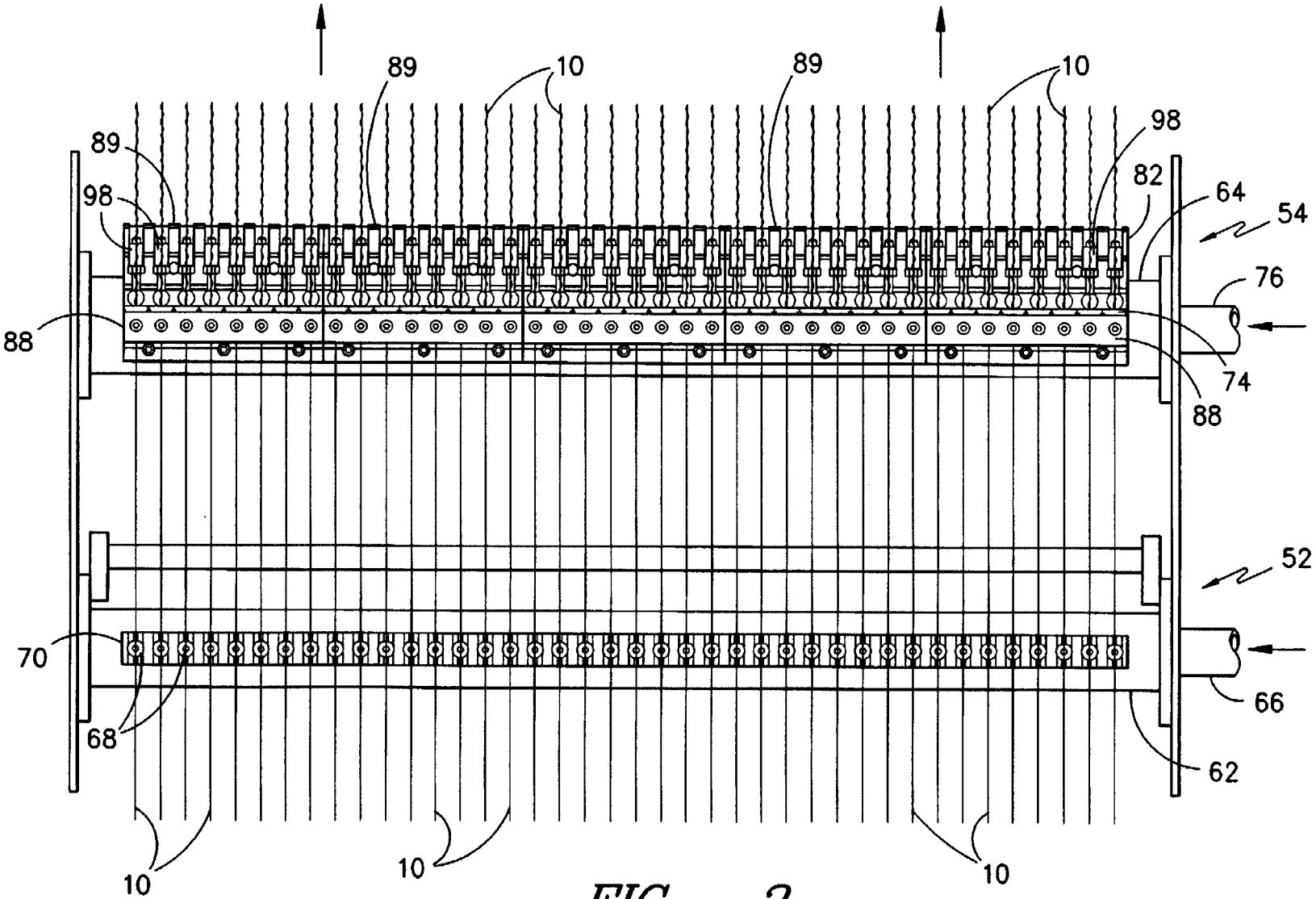
FIG. 3 is a top view of the yarn texturing apparatus taken on line 3—3 of FIG. 2.

Looking at FIGS. 2 and 3, the water manifolds 62 are located downstream of the corresponding air manifolds 64 and are stacked four high to provide compactness. Each manifold 62 is supplied water by a conduit 66 and has a small water opening 68 to apply water to the yarn 10 as it passes through the guide 70 mounted over each opening 68. The water on the yarn enhances the bulking of the yarn as it passes over the air manifold 64 due to the energy of the water hitting the filaments of the yarn as it is driven upward and outward by the force of the air from the manifold.

Looking now to FIGS. 2–5, there is shown an air manifold 64 corresponding to each water manifold 62 supplied with air at a pressure of about 160 psi through the conduit 72 supplied from a suitable air source. Corresponding to each water opening 68 is a texturing jet 74 supplied with air under pressure from the manifold 64 through a conduit 76. The air passes from the conduit 76 into the body of the jet 74 contacts the yarn 10 as it blows outwardly against the ball 78 to enhance the texturing and bulking action of the air against the filaments of the yarn 10. The action of the ball 78 is well known in the art and the position of the ball 78 relative to the jet opening 80 is selected depending on the amount of bulk desired in the yarn.

Figure 4:
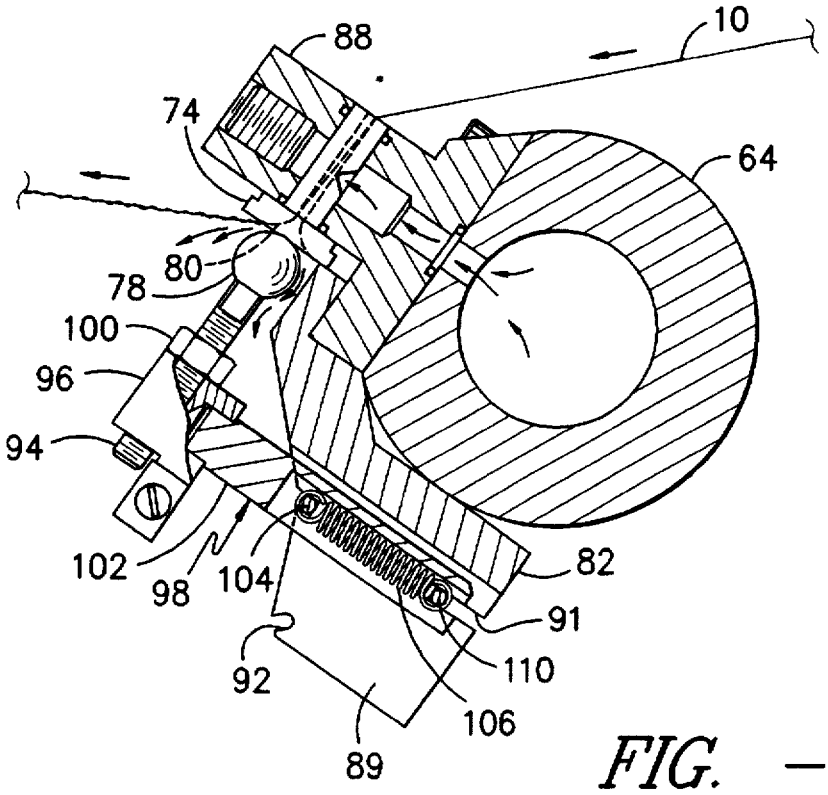
FIGS. 4 and 5 are enlarged views of the yarn texturing nozzle with the texturing ball in operative and inoperative position.
Figure 5:
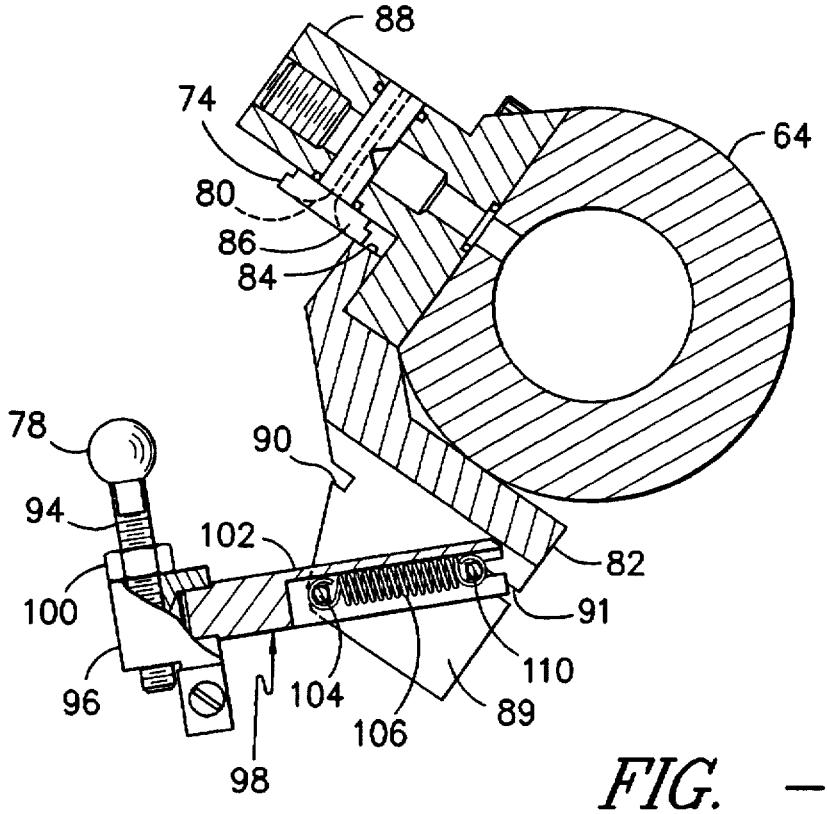

As shown in FIGS. 3–5, the balls 78 are mounted on block 82 that accommodates eight balls and is mounted so that one surface 84 abuts the open edge 86 of the air jet 74 to maintain it in position in the jet housing 88. This is the preferred arrangement of the balls 78 but obviously the balls could be mounted on a single support extending across the whole unit or could be individually mounted with one separate ball unit for each texturing position.

Extending outward downstream of the yarn 10 is a partition 89 for each ball 78 having groves 90, 91 and 92 therein. The ball 78 is mounted on one side of a screw 94 which screws into the block portion 96 of the ball support member 98 and has a nut 100 engaging same to fix the position of the ball 78. Extending downward from the block portion 96 is a lever member 102 having a pin 104 projecting outwardly therefrom to support the upper portion of a spring 106. In its operational position, the pin 104 engages the grove 90 while the lower end of the spring is secured by a pin member 110 located in the grove 91 in the lower portion of the partition 89 to maintain the ball in its selected position adjacent the outlet of the air jet 74.

When it is necessary to clean, change jets 74 and/or thread-up the air jets 74, the block portion 96 can be pulled upward against the action of the spring 106 and the ball housing rotated to the position shown in FIG. 5 whereat the pin member 104 is allowed to engage the grove 92. Once the required operation on the jet 74 is completed, the ball apparatus can be returned to its desired operating position with the pen 104 once again engaging the grove 90 in the position 89.

It can be seen that the above ball and jet construction allows the relationship between the air jets 74 and the ball 78 to be maintained once the ball 78 has been positioned by adjusting the screw member 94 when the ball member has been moved for maintenance purposes.

The above described apparatus and process describes an efficient method to continuously draw and texture POY filament yarn, such as polyester, eliminating the time consuming step of winding a bobbin of textured yarn which has to be creeled prior to warping. This results in the production of a better yarn at a cheaper cost since the yarn does not have to be handled physically by an operator prior to warping resulting in a reduction of production cost as well as inadvertent damage to the yarn.

As mentioned above, the heater 24 is deactivated and heater 30 is used to supply heat for drawing of the yarn but it is within the scope of the invention to use heater 24 for drawing and heater 30 for post shrinkage or to activate heater 24 in the disclosed process for the purpose of preheating of the drawn and textured yarn.

It is contemplated that other modifications can be made to process and/or apparatus without departing from the scope or spirit of the invention and it is desired that the invention be limited only by the scope of the claims:

We claim:

1. Apparatus to texture synthetic yarn comprising: a frame, means mounting a plurality of air jets across said frame, means to supply at least one yarn to each of said jets, means to supply air under pressure to each of said air jets, a ball member mounted at the outlet of each of said air jets to enhance bulkiness of the yarns textured in said air jets, means mounting said air jet to allow movement of said air jets into and out of operative relationship with said air jet and means to adjust the position of each of said balls individually with respect to its air jet.

2. The apparatus of claim 1 wherein said means to supply yarn to said air jet includes a means to apply moisture on said yarns prior to supply of same to said air jets.

3. The apparatus of claim 2 wherein said yarn is polyester.

4. The apparatus of claim 1 wherein said means to allow movement of said air jets includes a plate member projecting outwardly from air jet, a notch in said plate member adjacent said air jet and a notch in said plate member remote from said air jet, said ball member including a lever arm pivotally connected to said plate member having a pin member operably associated with one or the other of said notches and spring means operably associated with said pin member to retain said lever arm in one of said notches.

5. The apparatus of claim 4 wherein said ball member is rotatably mounted to said lever member and includes means to lock the ball in a fixed position.

6. The apparatus of claim 2 wherein said means to allow movement of said air jets includes a plate member projecting outwardly from air jet, a notch in said plate member adjacent said air jet and a notch in said plate member remote from said air jet, said ball member including a lever arm pivotally connected to said plate member having a pin member operably associated with one or the other of said notches and spring means operably associated with said pin member to retain said lever arm in one of said notches.

7. The apparatus of claim 6 wherein said ball member is rotatably mounted to said lever member and includes means to lock the ball in a fixed position.

* * * * *